US006168312B1

(12) United States Patent
Hausslein

(10) Patent No.: US 6,168,312 B1
(45) Date of Patent: Jan. 2, 2001

(54) CLOSURE SYSTEM FOR PLIABLE CONTAINER

(75) Inventor: Robert W. Hausslein, Lexington, MA (US)

(73) Assignee: Arthur D. Little Enterprises, Inc., Cambridge, MA (US)

( * ) Notice: Under 35 U.S.C. 154(b), the term of this patent shall be extended for 0 days.

(21) Appl. No.: 09/328,360

(22) Filed: Jun. 9, 1999

(51) Int. Cl.[7] ..... B65D 33/24; B65D 33/30
(52) U.S. Cl. ..... 383/68; 383/90
(58) Field of Search ..... 383/43, 68, 82, 383/83, 85, 88, 89, 90

(56) References Cited

U.S. PATENT DOCUMENTS

| | | | | |
|---|---|---|---|---|
| 288,118 | | 11/1883 | Reidy . | |
| 670,029 | | 3/1901 | Meier . | |
| 1,064,446 | * | 6/1913 | Courtney | 383/82 X |
| 1,124,091 | | 1/1915 | Willoughby . | |
| 1,138,882 | | 5/1915 | Meier . | |
| 1,265,996 | | 5/1918 | Cerny . | |
| 1,654,921 | * | 1/1928 | Critelli | 383/68 |
| 1,658,294 | | 2/1928 | Lewis . | |
| 1,794,577 | | 3/1931 | Brell . | |
| 1,798,945 | | 3/1931 | Lamarthe . | |
| 1,982,845 | | 12/1934 | Wagman . | |
| 2,000,928 | | 5/1935 | Cundall et al. . | |
| 2,037,110 | | 4/1936 | Bischoff . | |
| 2,040,271 | | 5/1936 | Rosenzweig . | |
| 2,067,367 | | 1/1937 | Willetts et al. . | |
| 2,074,843 | | 3/1937 | Hiering . | |
| 2,080,402 | | 5/1937 | Herman . | |
| 2,084,757 | | 6/1937 | Alter . | |
| 2,093,976 | | 9/1937 | Farmer . | |
| 2,125,354 | | 8/1938 | Meier . | |
| 2,142,904 | | 1/1939 | Lamarthe . | |
| 2,150,627 | | 3/1939 | Lieber . | |
| 2,158,955 | | 5/1939 | Blacher . | |
| 2,227,390 | | 12/1940 | Green . | |
| 2,232,888 | | 2/1941 | Schimelmitz . | |

(List continued on next page.)

FOREIGN PATENT DOCUMENTS

| | | |
|---|---|---|
| 705748 | 3/1965 | (CA) . |
| 2075772 | 9/1998 | (CA) . |
| 324546 | 11/1957 | (CH) . |
| 179441 | 12/1906 | (DE) . |
| 2 304 670 | 1/1973 | (DE) . |
| 0 201 257 | 11/1986 | (EP) . |
| 0 496 923 A1 | 8/1992 | (EP) . |
| 800 369 | 7/1936 | (FR) . |
| 736319 | 9/1955 | (GB) . |
| 994533 | 6/1965 | (GB) . |
| 111005 | 11/1934 | (HU) . |
| 105 814 | 10/1942 | (SE) . |

OTHER PUBLICATIONS

"Horizontal Pouch Machines", VOLPAK Packaging Machines, No Date.
"Variable Cycle", EMZO, MK 1000C, No Date.

* cited by examiner

*Primary Examiner*—Jes F. Pascua

(57) ABSTRACT

A closure system for use in repetitively opening and sealing closing an openable end of a pliable container includes at least one bowed band which is connected to the container, as well as at least one closure member. In certain preferred embodiments, bands are connected to opposing side walls of the container, with the bands being interconnected by the closure member. When the container assumes an open condition, the bands are generally located in offset planes and, when the container is in a closed condition, the bands nest with at least one side wall portion of the container being located between the bands. The closure member has spring characteristics which tend to bias the bands together when the closed condition is selected, yet permits the container to be readily maintained in the open condition when desired. In other preferred embodiments, a closure member which tends to coil up is utilized to establish the closed condition.

37 Claims, 9 Drawing Sheets

U.S. PATENT DOCUMENTS

| | | |
|---|---|---|
| 2,338,927 | 1/1944 | Gerendas . |
| 2,409,621 | 10/1946 | Geimer et al. . |
| 2,564,570 | 8/1951 | Hatfield . |
| 2,572,686 | 10/1951 | Andre . |
| 2,635,788 | 4/1953 | Snyder et al. . |
| 2,804,113 | 8/1957 | Nash . |
| 2,822,012 | 2/1958 | Gold . |
| 2,873,905 | 2/1959 | Denton . |
| 2,922,568 | 1/1960 | Harker . |
| 2,973,131 | 2/1961 | Mead et al. . |
| 3,066,846 | 12/1962 | Domigan . |
| 3,138,838 | 6/1964 | Richardson . |
| 3,141,221 | 7/1964 | Faulls, Jr. . |
| 3,149,772 | 9/1964 | Olsson . |
| 3,201,030 | 8/1965 | Pollack . |
| 3,259,302 | 7/1966 | Rocchisani . |
| 3,272,248 | 9/1966 | O'Farrell . |
| 3,366,312 | 1/1968 | Lowenberg et al. . |
| 3,406,853 | 10/1968 | McLeod . |
| 3,442,437 | 5/1969 | Mann . |
| 3,446,420 | 5/1969 | Rinecker . |
| 3,782,601 | 1/1974 | Krawagna . |
| 4,142,346 | 3/1979 | De Biasi . |
| 4,210,249 | 7/1980 | Holmes . |
| 4,276,982 | 7/1981 | Sibrava et al. . |
| 4,317,478 | 3/1982 | Babbidge . |
| 4,593,408 | 6/1986 | Drobish et al. . |
| 4,617,683 | 10/1986 | Christoff . |
| 4,840,611 | 6/1989 | Van Erden et al. . |
| 4,892,512 | 1/1990 | Branson . |
| 4,898,477 | 2/1990 | Cox et al. . |
| 4,997,104 | 3/1991 | Pohl . |
| 5,000,500 | 3/1991 | Almog . |
| 5,002,245 | 3/1991 | Hansen et al. . |
| 5,037,138 | 8/1991 | McClintock et al. . |
| 5,094,707 | 3/1992 | Bruno . |
| 5,174,658 | 12/1992 | Cook et al. . |
| 5,181,365 | 1/1993 | Garvey et al. . |
| 5,184,896 | 2/1993 | Hammond et al. . |
| 5,328,436 | 7/1994 | Larsen et al. . |
| 5,337,539 | 8/1994 | Barton . |
| 5,372,428 | 12/1994 | Bruno et al. . |
| 5,377,474 | 1/1995 | Kovacs et al. . |
| 5,383,989 | 1/1995 | Mc Mahon . |
| 5,524,990 | 6/1996 | Buck . |
| 5,557,907 | 9/1996 | Malin et al. . |
| 5,570,569 | 11/1996 | Masuda . |
| 5,824,380 | 10/1998 | Hagen . |
| 6,022,144 * | 2/2000 | Hausslein ..... 383/89 X |

FIG. 14
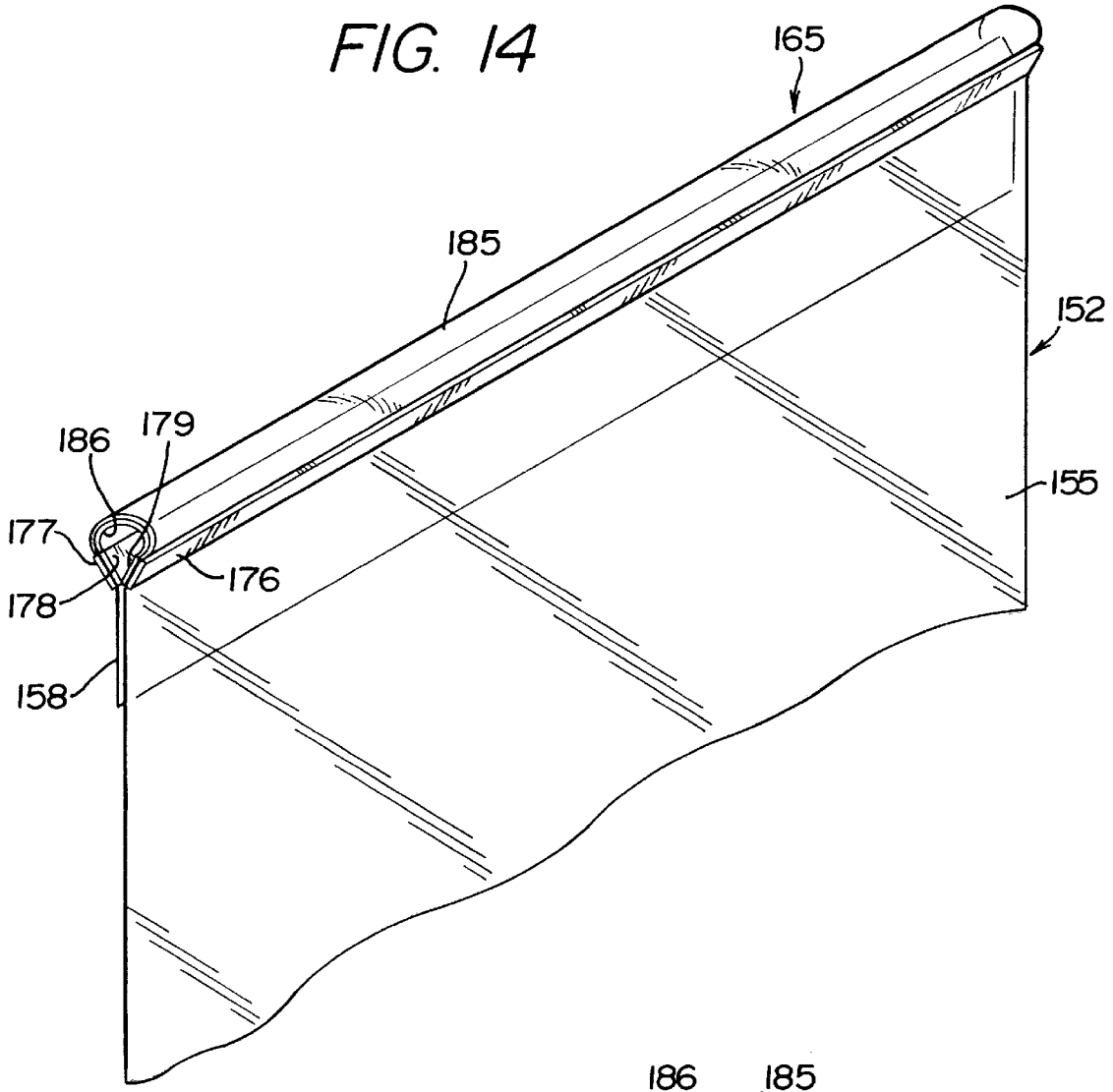
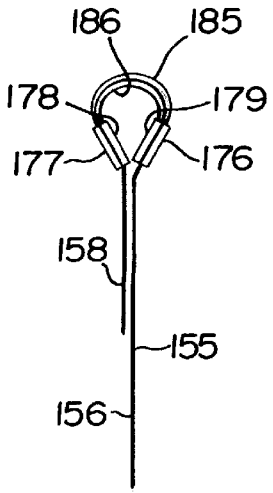
FIG. 15

FIG. 16
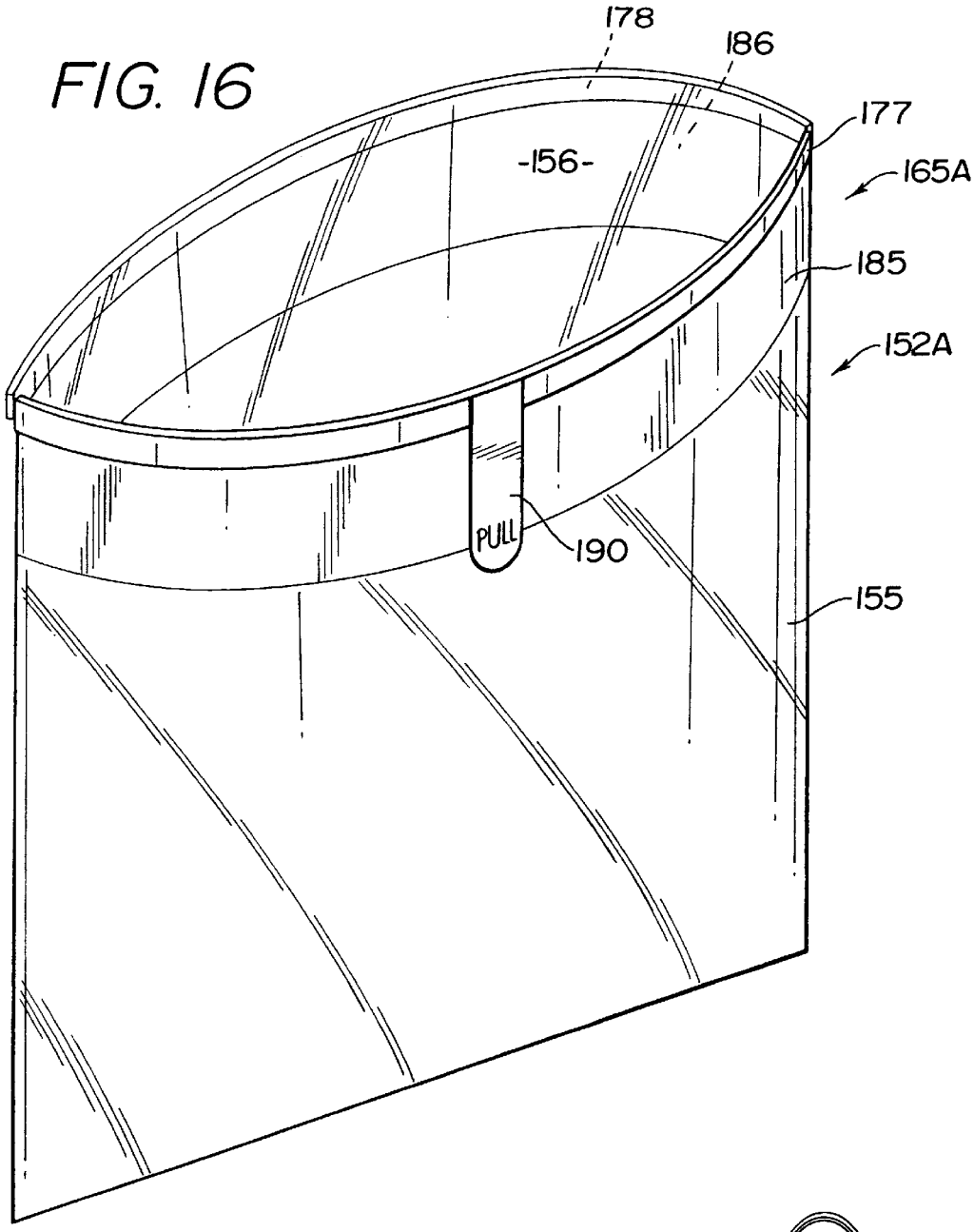
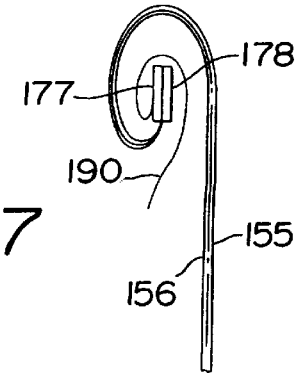
FIG. 17

CLOSURE SYSTEM FOR PLIABLE CONTAINER

BACKGROUND OF THE INVENTION

1. Field of the Invention

The present invention pertains to the art of packaging and, more specifically, to a system for repetitively opening and sealingly closing an openable end of a pliable container, such as a bag.

2. Discussion of the Prior Art

Pliable or flaccid containers are widely used to store both edible and non-edible products. For example, snack items, such as various types of chips and cereals, are typically packaged in pliable containers. These containers are generally sealed at both ends for initial packaging purposes and then one of the ends is opened to access the product. It is often desirable to utilize the container to store the product for extended periods of time and to repetitively open and close one end of the container to selectively access the contents thereof.

When used to store edible food items, it is particularly advantageous to adequately seal the openable end of the container between uses in order to prolong the useful life of the food items stored therein. For this reason, once the initial seal at one end of the container is broken, it is common practice to roll up the openable end of the pliable container for storage. Unfortunately, the rolled-up ends of such pliable containers generally tend to unroll between uses, which leads to the food items becoming stale prematurely.

Proposed solutions to this problem include providing various types of closure structures at the openable end to maintain the side walls of the container in a close bearing relationship for sealing purposes. For example, it is known to utilize a clip to prevent the openable container end from unrolling. Since such clips are completely separate from the container, they can be misplaced and are therefore often only used when readily available. In addition, these clips often tend to break and only directly maintain a small central section of the openable container end in a rather tight, closed condition. Zip-type closure arrangements have also become quite prevalent for use with certain types of bags. Such closure arrangements are considered advantageous in at least they generally extend entirely across the width of the openable end and are formed integral with the container. However, such closure arrangements are considered to be quite difficult to use, particularly for children and the elderly, due to the required dexterity. In addition, these closure arrangements do not provide an immediate indication that a complete seal has been established. Instead, the entire arrangement must be systematically sealed from one end of the opening to the other and if any portion is not sealed, the purpose of the entire closure can be completely compromised.

Based on the above, there exists a need in the art for a simple, inexpensive closure system for use with pliable containers which will be effectively used to repetitively open and sealingly close the pliable containers.

SUMMARY OF THE INVENTION

The present invention is directed to a closure system for use in repetitively opening and closing an openable end of a pliable container. In accordance with various preferred embodiments of the invention, the closure system includes first and second bands extending transversely across a first side wall of the pliable container. The second band is connected to the first band and arranged in a distinct plane from the first band when the closure system assumes an open condition, and nests with the first band in a common plane when the closure system assumes a closed condition wherein the openable end of the pliable container is sealing closed with at least a portion of a second side wall of the container being located between the first and second bands.

The closure system also includes structure attached to each of the first and second bands which develops a biasing force tending to maintain the system in the closed condition in order to create a good sealing condition at the openable end. Although this closure structure can vary in accordance with the present invention, it generally constitutes at least one spring member acting between the first and second bands. This structure can take various forms, such as one or more clips or clamps, a toggle unit, a curl strip and the like, without departing from the invention. In any case, the spring structure also cooperates with the bands to enable a stable open condition for the pliable container to ease access to the contents of the container. Therefore, the spring structure and bands are specifically designed and interconnected in a manner which optimizes the sealing condition of the sides of the pliable container when closed, but enables a stable open condition to be assumed as well.

Additional objects, features and advantages of the present invention will become more readily apparent from the following detailed description of preferred embodiments thereof when taken in conjunction with the drawings wherein like reference numerals refer to corresponding parts in the several views.

BRIEF DESCRIPTION OF THE DRAWINGS

FIG. 14 shows the pliable container and closure system of FIG. 13 in a closed condition;

FIG. 15 is a side view of an upper portion of the container and closure system of FIG. 14;

FIG. 16 shows a pliable container in an open condition similar to that of FIG. 13 but incorporating a closure system according to a fifth embodiment of the invention; and FIG. 17 is a side view of an upper portion of the container and closure system of FIG. 16.

DETAILED DESCRIPTION OF THE PREFERRED EMBODIMENTS

Figure 1:
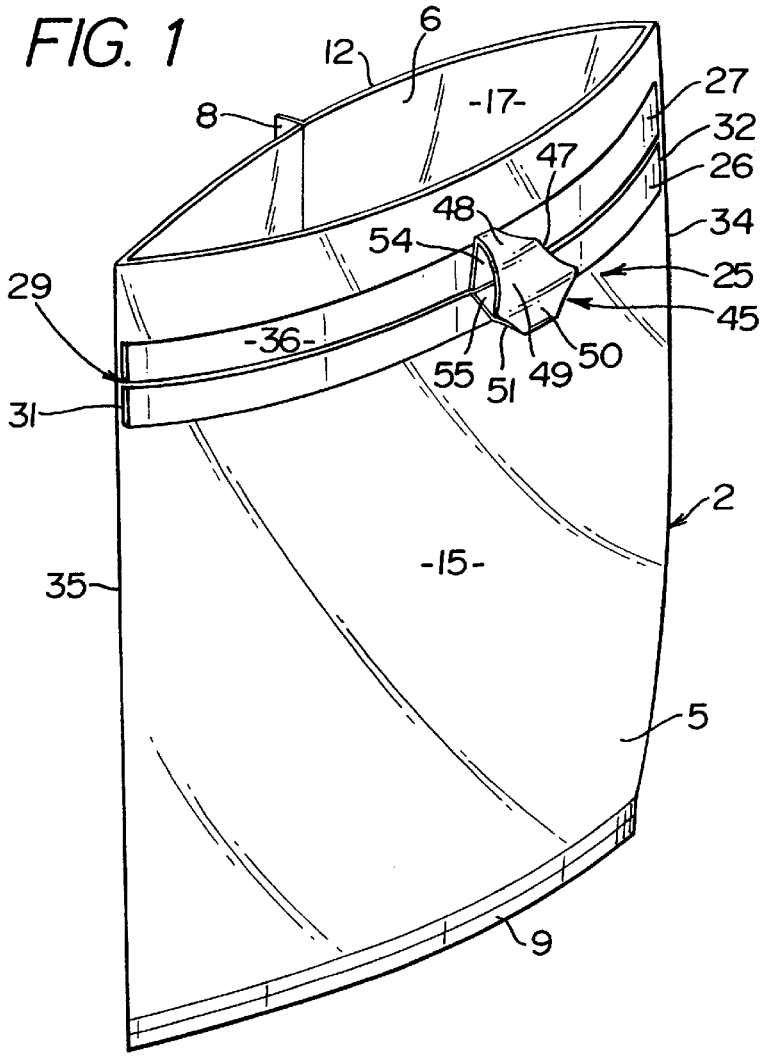
FIG. 1 is a perspective view of an open pliable container incorporating a closure system constructed in accordance with a first preferred embodiment of the present invention.
Figure 2:
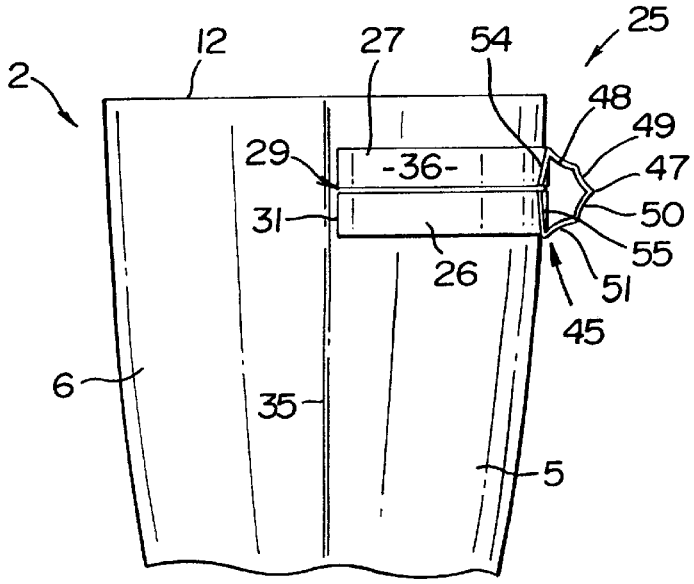
FIG. 2 is an enlarged side view of an upper portion of the container and closure system shown in FIG. 1.

With initial reference to FIGS. 1 and 2, a pliable or flaccid container is generally indicated at 2. In the embodiment shown, pliable container 2 constitutes a bag generally of the type known for use in packaging food items such as potato chips and cereals. Therefore, pliable container 2 includes opposing side walls 5 and 6 which are generally formed from wrapping a single piece of material, typically referred to as a web, along a longitudinal seam line 8. Pliable container 2 includes a closed end 9 and an openable end 12. The material for pliable container 2 is generally constituted by paper or plastic, but can take other forms including foils, laminated structures, leather, cloth and the like without departing from the invention. On a typical chip or cereal bag, closed end 9 would be formed from heat sealing side walls 5 and 6. In a similar manner, openable end 12 would be originally provided with a commensurate heat sealed portion that has been cut off to arrive at the arrangement shown in FIG. 1 but which typically would extend above openable end 12 as depicted. In any event, pliable container 2 includes an outer surface 15 and an inner surface 17, with the interior of pliable container 2 being adapted to be filled with food or other packaged items.

In accordance with this first preferred embodiment of the invention, pliable container 2 is provided with a closure system generally indicated at 25. As illustrated, closure system 25 includes a first band 26 located in a first plane or level adjacent openable end 12 and a second band 27 arranged above first band 26. In the most preferred form of the invention, bands 26 and 27 are formed of plastic, however, other materials including metal could also be utilized. As shown in these figures, bands 26 and 27 extend across side wall 5 in a generally parallel manner with a gap 29 arranged therebetween. In addition, each band 26, 27 has associated ends 31 and 32 which are preferably arranged adjacent respective creased edges 34 and 35 of pliable container 2. Therefore, the most preferred form of closure system 25 has bands 26 and 27 extending across pliable container 2 in a substantially parallel manner and for a distance substantially equal to the entire width of pliable container 2. Certainly, the most preferred form of the invention utilizes bands 26 and 27 which have associated lengths slightly less than or equal to a direct distance between creased edges 34 and 35 along side wall 5. Furthermore, each band 26 and 27 is preferably bowed in a relaxed state so as to define an outer surface 36 which is concave and an inner surface (not labeled) that is secured to or formed as part of side wall 5.

As clearly illustrated in FIG. 1, band 27 is arranged in a plane spaced vertically above band 26. At this point, it should be realized that bands 26 and 27 can be attached, either directly or indirectly, to pliable container 2 in various ways, including a stitching operation or through the use of other types of mechanical fasteners known in the art. In addition, various types of adhesives, including pressure sensitive, heat activated and double-sided tapes could also be utilized. When applied during the formation of a typical pliable container for food items and the like, heat sealing bands 26 and 27 is preferred due to the ease of implementation and associated economical advantages. In any event, it should be understood that bands 26 and 27 employed in accordance with this embodiment of the invention may be attached to pliable container 2 through the use of various fastening arrangements. In addition, due to the preferred bowed construction of bands 26 and 27, it should be recognized that side wall 5 will tend to also bow to enhance access to within pliable container 2. If further enhanced opening of end 12 is desired, one or more similarly shaped bands (not shown) could be arranged across side wall 6, preferably at a height commensurate with band 27.

With this construction, bands 26 and 27 are essentially hinged together through a portion of pliable container 2 arranged in gap 29. Therefore, if side walls 5 and 6 are brought together from the position shown in FIG. 1 and then side walls 5 and 6 were folded such that band 27 is located in a substantially common plane with band 26 and side walls 5 and 6 are arranged therebetween, openable end 12 of pliable container 2 would be closed. However, owing to the bowing nature of bands 26 and 27, pliable container 2 would tend to assume the open position shown in FIG. 1 unless some other type of fastener, such as a clip, clamp, button arrangement, hook and loop arrangement or the like was incorporated to maintain the closed condition. However, in accordance with the present invention, closure system 25 also includes a spring member 45 which further interconnects bands 26 and 27. As perhaps best shown in FIGS. 1 and 2, spring member 45 includes a multi-faceted body 47 comprised of sections 48–51, as well as a pair of legs 54 and 55 which are hinged and in-turned from sections 48 and 51 respectively. Legs 54 and 55 are fixedly secured, through adhesion or otherwise, to bands 26 and 27 respectively. In the embodiment shown, spring member 45 is attached to bands 26 and 27 generally intermediate ends 31 and 32.

Before describing the manner in which closure system 25 is utilized to both maintain the opening and enhance the sealed closing of openable end 12 of pliable container 2, it should be recognized that the construction of spring member 45 can actually take various forms in accordance with the present invention. For instance, the number of facets for body 47 could be increased or decreased without departing from the invention. In addition, the manner in which body 47 is attached to bands 26 and 27 could vary. Furthermore, the number of spring members 45 utilized can also vary. This embodiment shows a single spring member 45, however numerous transversely spaced spring members 45 could be utilized, as well as an elongated spring member extending between ends 31 and 32 wherein the spring member is slit at various locations along its length.

In any event, regardless of its particular construction, spring member 45 of closure system 25 generally functions in a manner similar to a clip or clamp to generate a force that will keep side walls 5 and 6 folded when band 27 is shifted to a nested position wherein band 27 is in a generally common plane with band 26. Therefore, the force that keeps pliable container 2 open comes from the bowing nature of bands 26 and 27, while the closing force is developed by spring member 45. More specifically, when the user flattens and folds pliable container 2, openable end 12 will be maintained closed in a manner analogous to a typical binder clip which acts directly on bands 26 and 27. If either of bands 26 and 27 is significantly stronger than the other, openable end 12 of pliable container 2 will assume an arcuate configuration when closed. In accordance with the most preferred embodiment, bands 26 and 27 are generally equally bowed such that a substantially straight closure (see FIGS. 3 and 4) is developed. This configuration is selected as it is considered more aesthetically appealing. Of course, to assume this position, the force developed by spring members 45 must flatten out the bowed bands 26 and 27 and must be strong enough to overcome any tendency of the bowed bands to assume their relaxed, bowed condition.

It should be noted that spring member 45 is freely hinged at its line of attachment to each of bands 26 and 27. With this configuration, when bands 26 and 27 are unfolded to the position shown in FIGS. 1 and 2, all of the closing force associated with spring member 45 is directed in the plane of the bands straight through the hinge. Therefore, there is no tendency of the bands to rotate toward the folded condition such that closure system 25 reaches an equilibrium position in both the open and closed conditions for pliable container 2. This equilibrium position is owed, at least in part, due to the bowing of the bands 26 and 27. It has been found that even a slight bowing of the bands 26 and 27 is enough to stabilize them in the open position. Therefore, since spring member 45 is hinged through its attachment to each of bands 26 and 27, bands 26 and 27 can be toggled between the closed position and the open position, wherein the spring member 45 is not trying to rotate bands 26 and 27 together but rather enables bands 26 and 27 to assume their naturally bowed configuration when pliable bag 2 is open. For this reason, the bowing force associated with bands 26 and 27 need not be extremely strong while still being able to achieve a bowed configuration when pliable container 2 is open to enhance access to the interior of pliable container 2.

Figure 3:
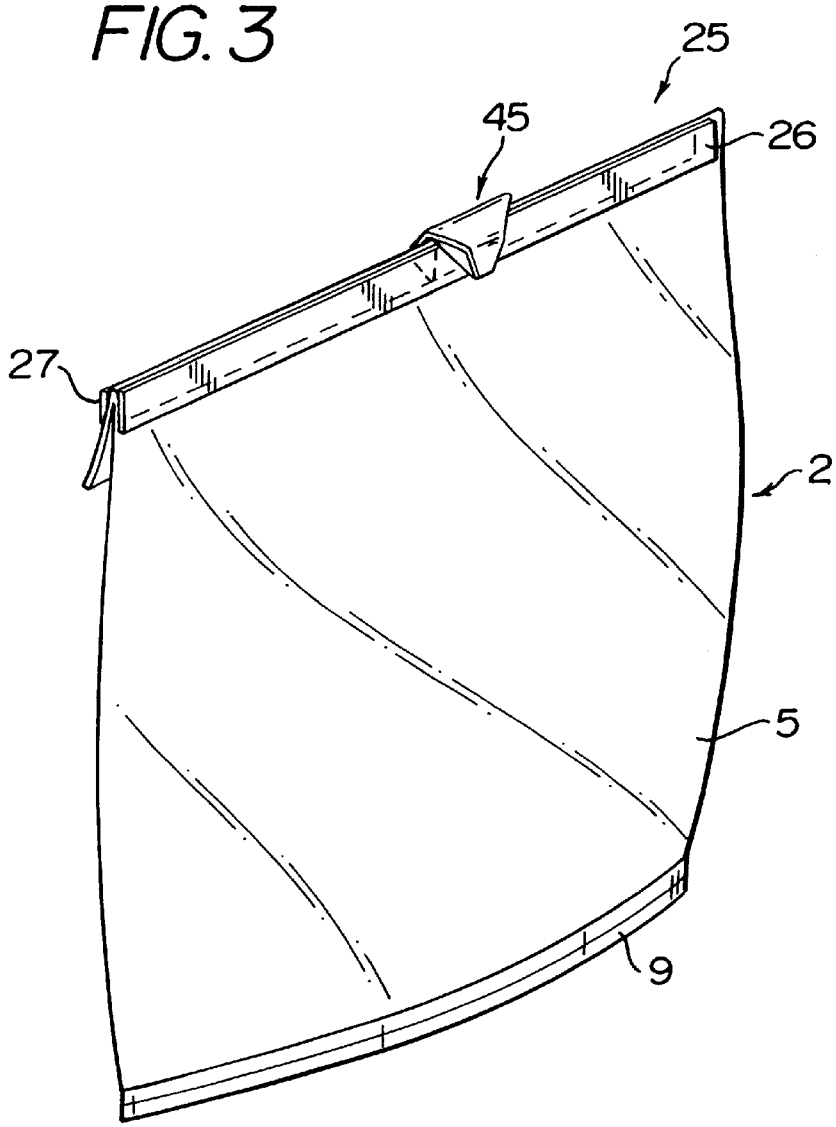
FIG. 3 is a perspective view of the pliable container and closure system of FIG. 1 shown in a closed condition.
Figure 4:
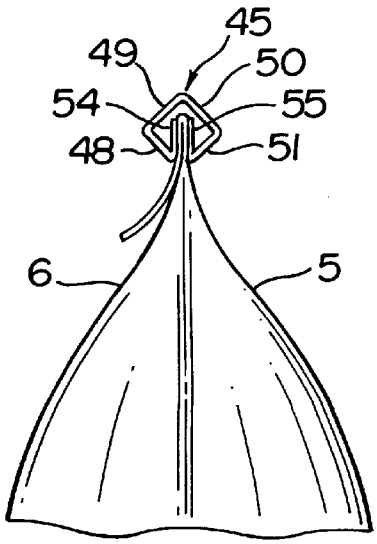
FIG. 4 is an enlarged side view of the upper portion of the pliable container and closure system of FIG. 3.

As mentioned above, bands 26 and 27 can toggle between a closed, folded position as shown in FIGS. 3 and 4 wherein portions of side walls 5 and 6 are sandwiched between bands 26 and 27 and spring member 45 squeezes bands 26 and 27 together into flat planes, and an open position, wherein bands 26 and 27 are arranged adjacent one another in different planes and spring member 45 actually squeezes the transverse edge of one band 26, 27 against the transverse edge of the other band 27, 26. Again, this achievement is due largely in part to the freely hinged nature of the interconnection between spring member 45 and bands 26 and 27.

FIGS. 5–8 illustrate a second preferred embodiment of the invention that is particularly suited for use in connection with a pliable container in the form of a gusseted bag generally indicated at 62. In the manner widely known in the art, gusseted bag 62 includes a pair of opposing side walls 65 and 66, as well as folding walls 68–71. In this embodiment, gusseted bag 62 has attached thereto a closure system generally indicated at 75 as clearly shown in these figures. Like the embodiment of FIGS. 1–4, closure system 75 includes a pair of bands 76 and 77 that preferably extend substantially entirely across a side wall 65 of bag 62, with ends 81 and 82 associated with each band 76, 77 terminating at creases (not separately labeled), located between side wall 65 and in-folding walls 69 and 70 respectively. However, unlike the embodiment of FIGS. 1–4, bands 76 and 77 are provided with up-turned flanges 90 and 91 respectively which abut each other and act as stops for closure system 75 when gusseted bag 62 assumes the open position shown in FIGS. 5 and 6 as will be more fully discussed below. Closure system 75 also includes a spring member 95 that includes a multi-faceted body 97 having, in the preferred embodiment shown, sections 98–102, as well as legs 104 and 105. As with the previous embodiment, legs 104 and 105 are fixedly secured or formed integral with bands 76 and 77.

Figure 5:
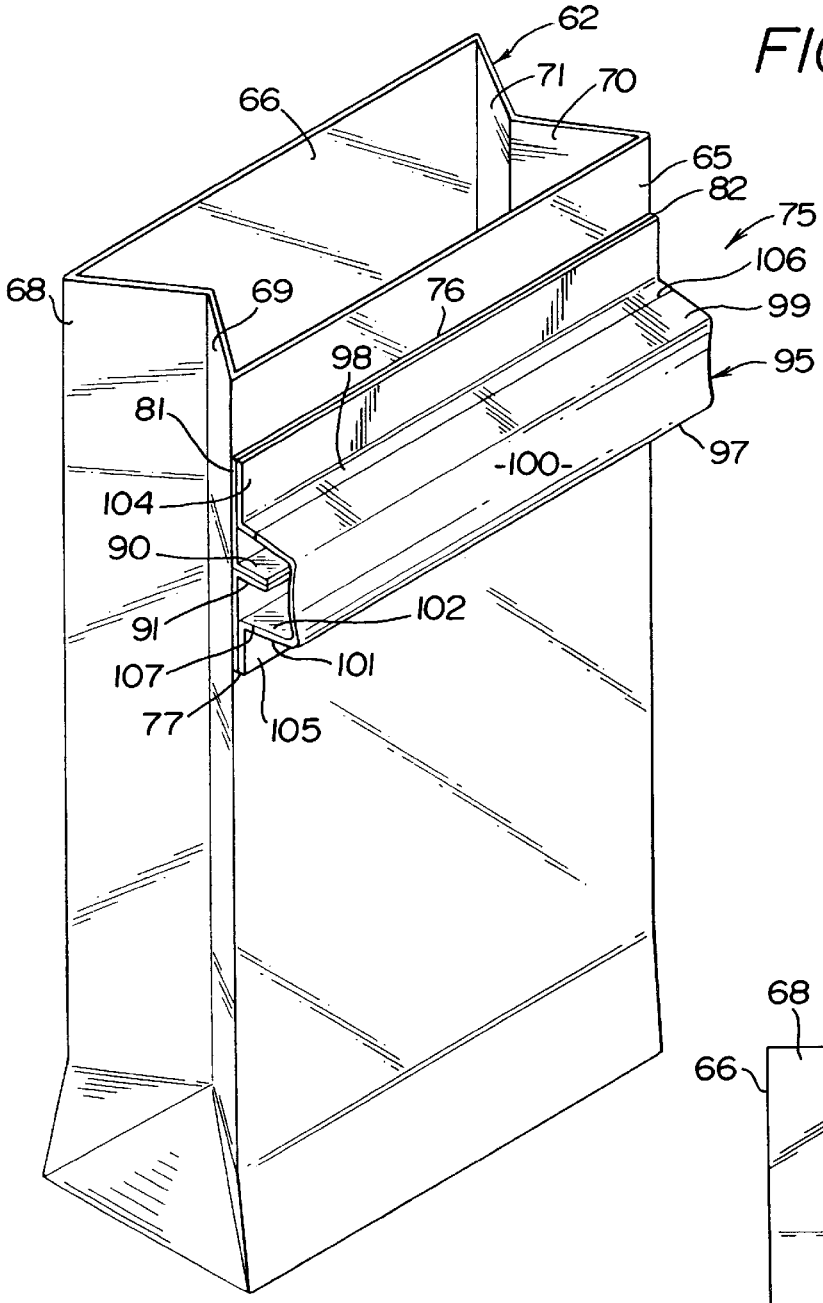
FIG. 5 is a perspective view of another container shown with an opened end and incorporating a closure system constructed in accordance with a second embodiment of the invention.
Figure 6:
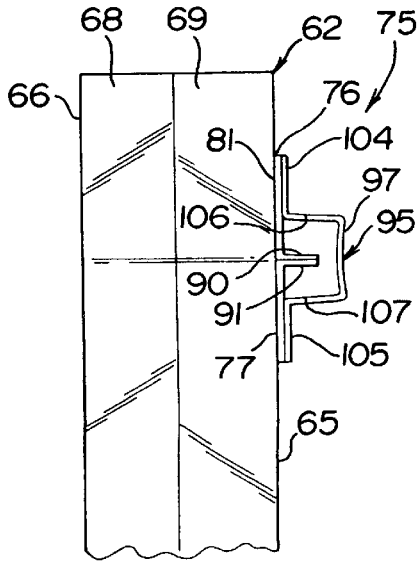
FIG. 6 is a side view of the container and closure system of FIG. 5.

As indicated above, there exists a toggle action between bands 26 and 27 in the embodiment of FIGS. 1–4. In the embodiment of FIGS. 5–8, the toggle action is actually defined in spring member 95. This arrangement is achieved by offsetting the hinges defined along lines 106 and 107 between legs 104 and 105 and body 97 of spring member 95, as well as adding the up-turned flanges 90 and 91. In other words, spring member 95 assumes an over-centering position as it toggles between open and closed positions. Therefore, when in the open condition of FIGS. 5 and 6, spring member 95 tends to rotate both bands 76 and 77, which are not bowed in this embodiment. However, rotation of bands 76 and 77 beyond the position shown in FIGS. 5 and 6 is not permitted due to the presence of up-turned flanges 90 and 91 which are abutting each other to act as a stop. Since spring member 95 goes through this overcentering action, closure system 75 inherently snaps between both open and closed positions. Therefore, this self-toggling action of closure system 75 eliminates the need for bands 76 and 77 to be bowed. Not bowing bands 76 and 77 is considered particularly useful on gusseted bags, when the bowing is unnecessary as such bags tend to more easily remain open.

Figure 7:
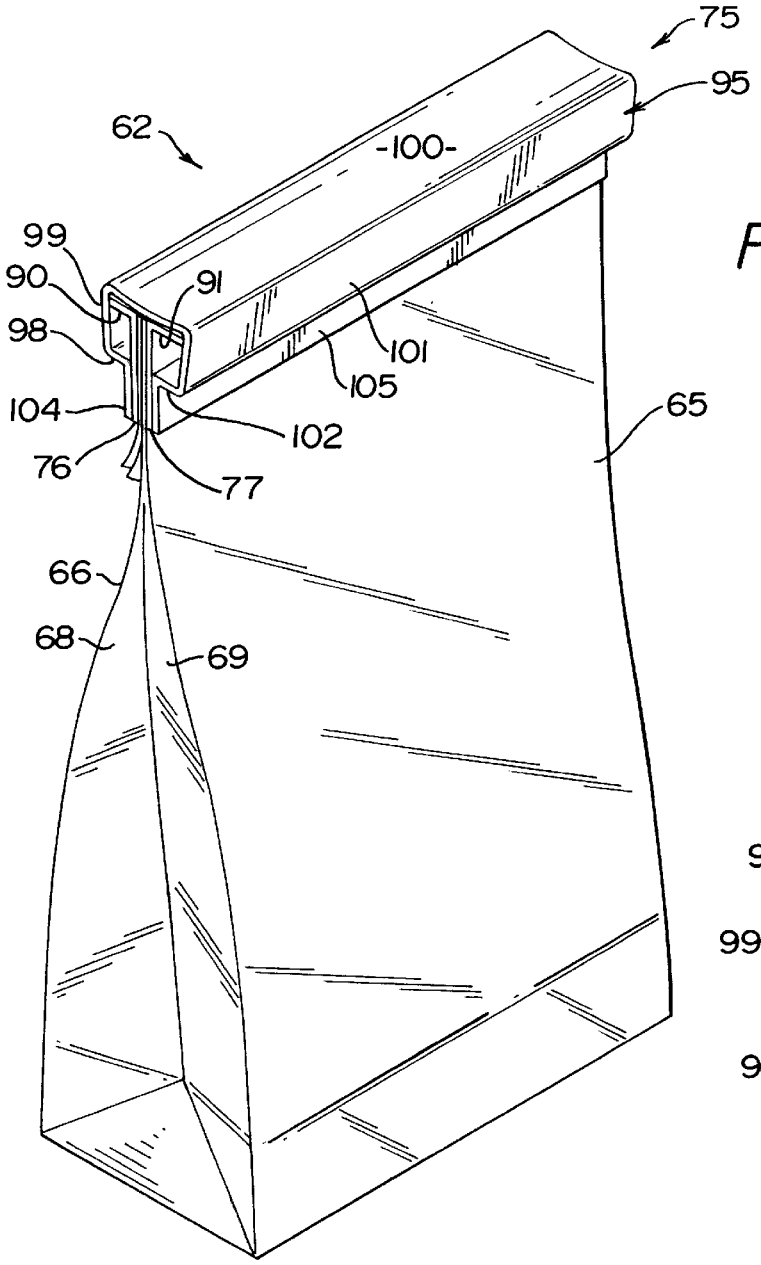
FIG. 7 is a perspective view of the container and closure system of FIG. 5 shown in a closed condition.
Figure 8:
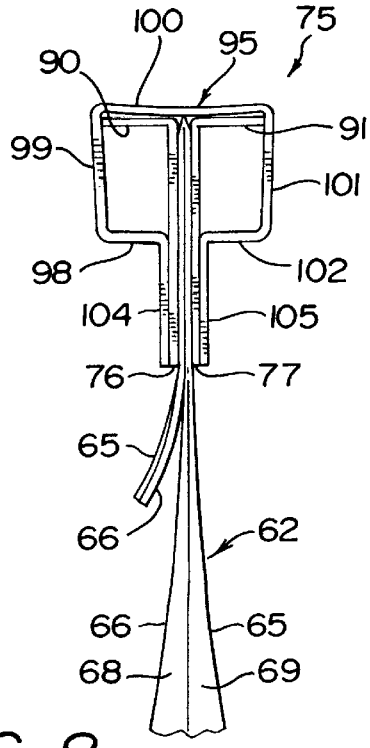
FIG. 8 is a side view of an upper portion of the embodiment of FIG. 7.
Figure 9:
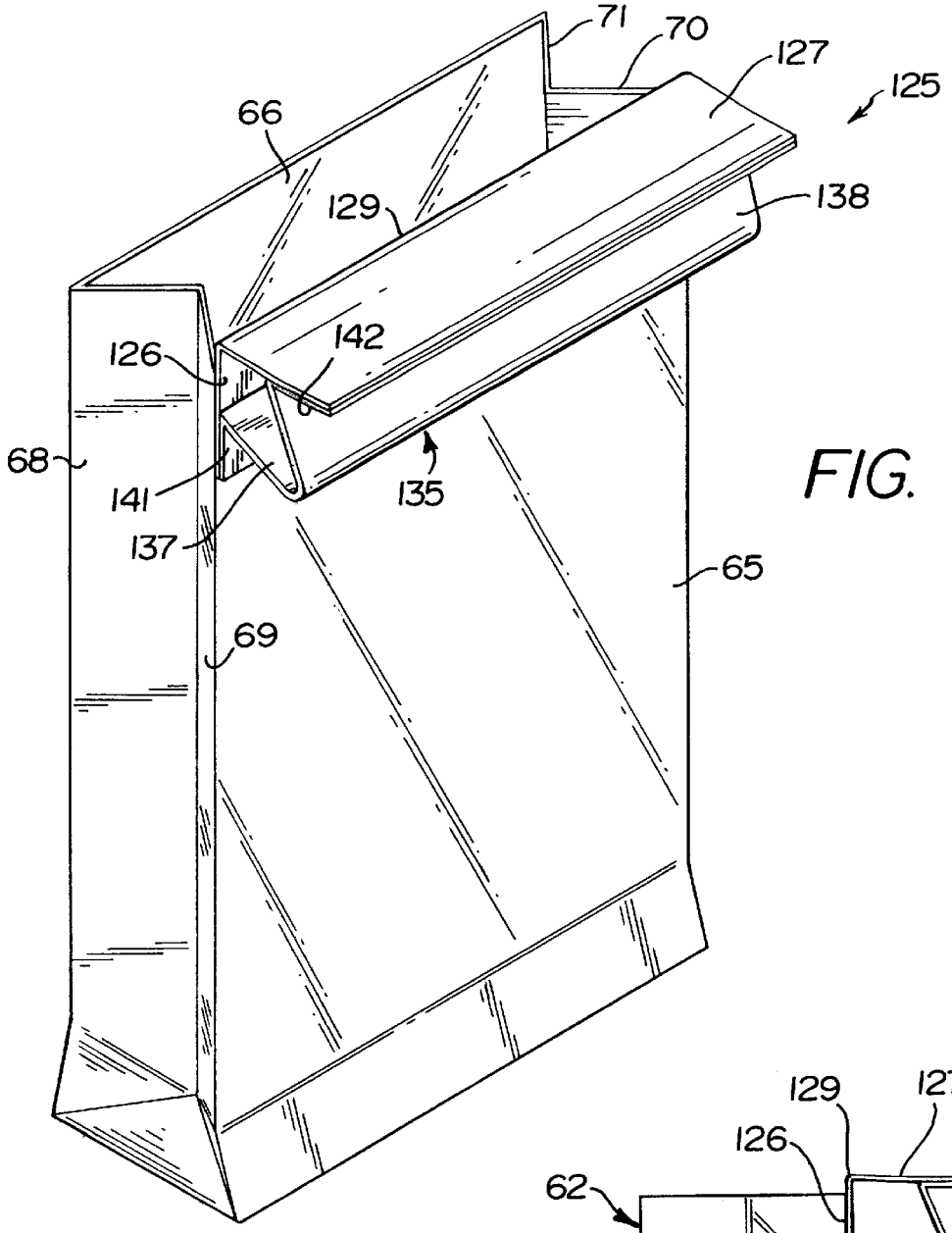
FIG. 9 illustrates a pliable container corresponding to that of FIG. 5 but carrying a closure system according to a third embodiment of the invention.
Figure 10:
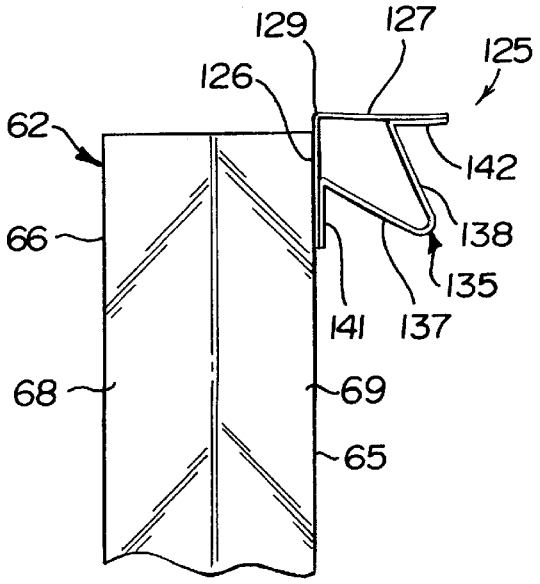
FIG. 10 is a side view of the upper portion of the container of FIG. 9 with the closure system in a closed condition.

Like the first described embodiment, bands 76 and 77 of the present embodiment also rotate to cause folded side walls 65 and 66 to be sandwiched between bands 76 and 77 when closure system 125 assumes the closed condition shown in FIGS. 7 and 8. Furthermore, both of these embodiments incorporate closure systems which are freely hinged to their associated bands. Also note that both spring members 45 and 95 are always acting to develop the squeezing force, whether opened or closed. For most designs, this force will be greater when the bag is open rather than closed, but the spring members 45 and 95 preferably never assume a relaxed state. In addition, in each of the embodiments, bands 26, 27 and 76, 77 are indirectly hinged through side walls 5 and 65 of pliable containers 2 and 62 respectively. If this was not the case, portions of side walls 5 and 65 would tend to bunch up and prevent bands 26, 27 and 76, 77 from rotating to a fully closed position wherein they are generally parallel to each other and in a common plane. Therefore, the invention avoids this potential problem by purposely not joining the bands 26, 27 and 76, 77 directly to each other. In addition, portions of bands 26, 27 and 76, 77 near the fold line, i.e., wherein the pliable container 2, 62 curves over the top of the fold from one side to the other, are purposely not secured to the respective side walls 5, 65. Increasing the gap between the bands 26, 27 and 76, 77 would, however, enable complete attachment at these locations. Furthermore, spring members 45 and 95, in their respective open conditions, seek to close by rotating the bands 26, 27 and 76, 77 around their respective fold lines, either forward or backward.

In the first described embodiment, bands 26 and 27 are preferably longer than an associated width of spring member 45. In addition, bands 25 and 26 are prevented from rotating by pre-fabricating them as bow springs. Therefore, when bands 26 and 27 are unfolded and allowed to naturally bow, spring member 45 is thereby held open. Bands 26 and 27 cannot, by themselves, rotate forward or backward around the curved fold line. On the other hand, when bands 26 and 27 are manually flattened, such that the fold line is substantially straightened, spring member 45 can rotate bands 26 and 27 together.

In the second embodiment, spring member 95 is prevented from rotating backward by the abutment of upturned flanges 90 and 91. In addition, spring member 95 is prevented from rotating forward by the overcenter action. As clearly illustrated in FIGS. 5–8, spring member 95 can be as wide as bands 76 and 77 so as to extend from one lateral edge to another lateral edge of pliable container 62 or even wider if desired. In fact, the entire closure system 75 may be fabricated as a single piece with integral hinges. In contrast, spring member 45 of the first embodiment must either be shorter in its transverse length than bands 26 and 27 or at least slit at various transverse locations since bands 26 and 27 cannot bow where they are hinged to the spring member 45. On the other hand, utilizing plastic for spring member 45 and bands 26 and 27 will assure that these elements are compliant enough such that utilizing many short spring segments can effectively provide a full width spring closure arrangement.

Reference will now be made to FIGS. 9–12 in describing a third preferred embodiment of the present invention. This embodiment is shown used on the gusseted bag corresponding to pliable container 62. For this reason, corresponding numbers for sections of the pliable container of this embodiment have been brought forth and therefore will not be reiterated here. However, this embodiment incorporates a closure system 125 that is constructed and operates in a somewhat different manner from that disclosed with respect to the first two embodiments. More specifically, closure system 125 includes a first band 126 that is attached directly to side wall 65 and a second band 127 that is hingedly connected at 129 to band 126. This embodiment of closure system 125 also incorporates a spring member 135 having first and second sections 137 and 138 which are hinged to bands 126 and 127 such as through respective legs 141 and 142. As clearly shown, legs 141 and 142 are fixedly secured to bands 126 and 127 respectively.

Figure 11:
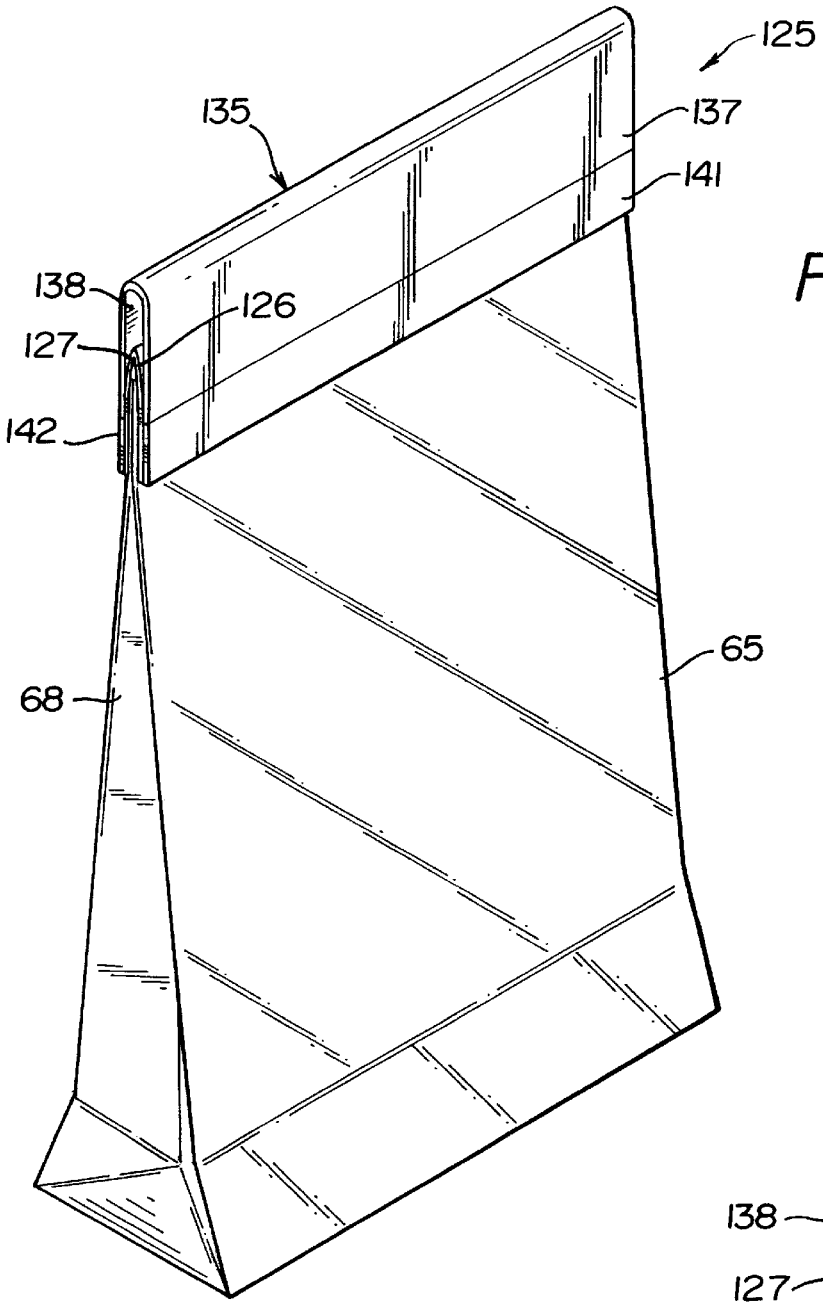
FIG. 11 shows the third closure system embodiment in a closed condition.
Figure 12:
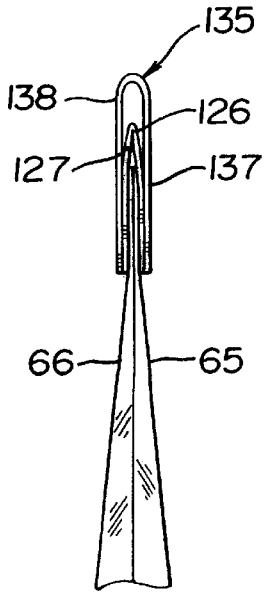
FIG. 12 is a side view of an upper portion of the container and closure system according to the embodiment of FIG. 11.

Closure system 125 is specifically constructed in accordance with the present invention for use in mounting at the top of a pliable container and does not require the folding over of the pliable container when positioning the closure system 125 in a closed position. Instead, closure system 125 is movable between the open position shown in FIGS. 9 and 10, wherein access to within the pliable container 62 is readily permitted, and a closed position as shown in FIGS. 11 and 12 wherein non-folding side walls 65 and 66 are sandwiched between bands 126 and 127. More specifically, upon closing, band 127 extends over the open top of pliable container 62 to assume the position shown in FIGS. 11 and 12 wherein bands 126 and 127 simply press side walls 65 and 66 together. Since a hinge between bands 126 and 127 is not defined by the pliable bag 62 itself, bands 126 and 127 are directly, hingedly connected in accordance with the invention such that band 127 is connected to pliable container 62 indirectly to band 126.

Figure 13:
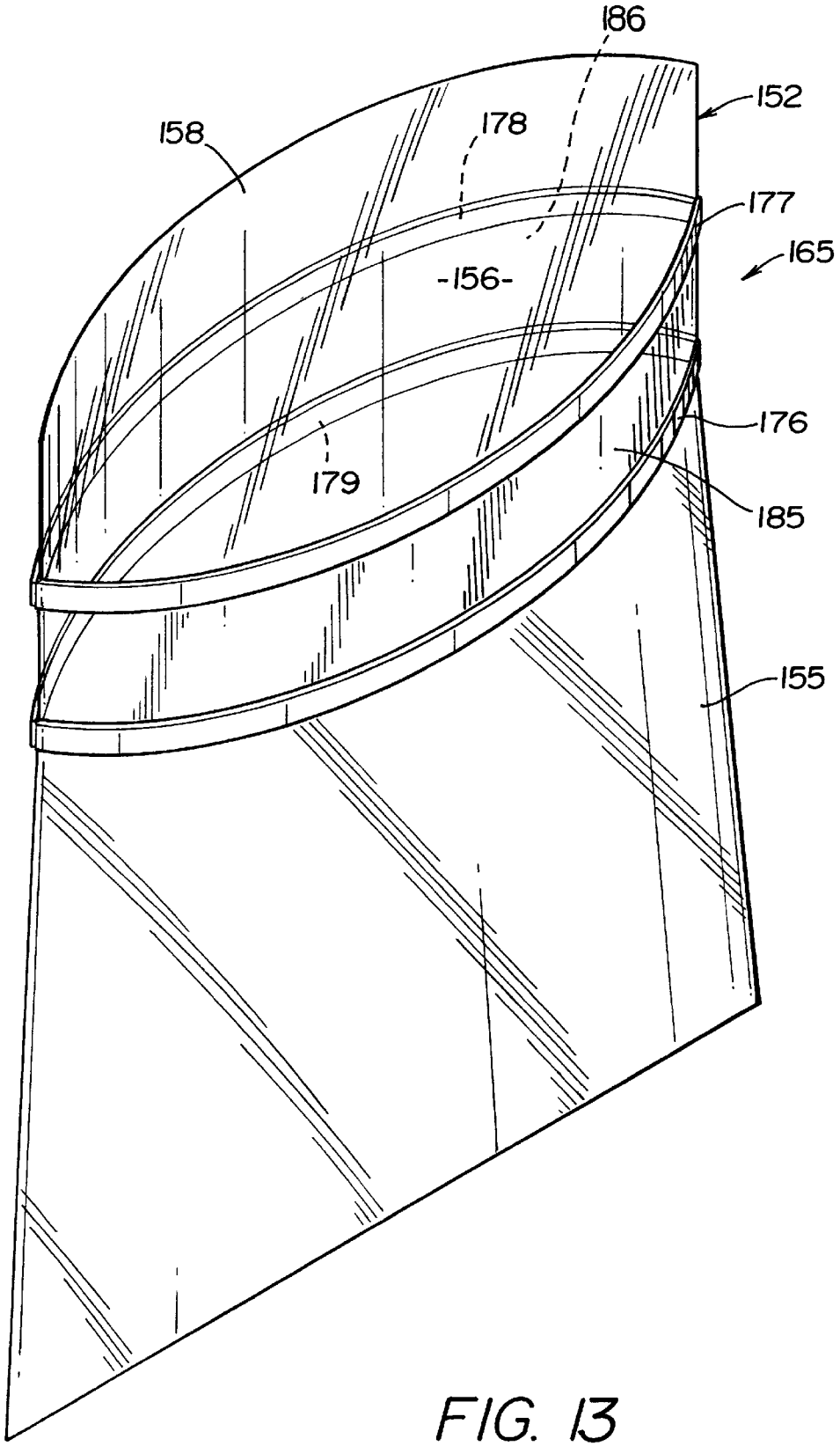
FIG. 13 illustrates another pliable container in an open condition which incorporates a closure system according to a fourth embodiment of the invention.

Reference will now be made to FIGS. 13–15 in describing a fourth embodiment of the closure system for a pliable container in accordance with the present invention. This embodiment depicts a pliable container 152 having opposing side walls 155 and 156. Although not a required feature of this embodiment, side wall 156 is shown to be longer at an openable end (not separately labeled) of pliable container 152 such that an extension flap 158 is shown. Attached to pliable container 152 is a closure system 165 incorporating a plurality of bands 176–179, as well as a pair of spring members 185 and 186. In the most preferred form, bands 176–179 are formed separate from pliable container 152 and are adhesively attached or otherwise fixedly secured thereto. In addition, each band 176–179 preferably bows outwardly such that, when pliable container assumes the open position shown in FIG. 13 an enhanced opening is provided to ease access to food or other products placed within pliable container 152.

As clearly shown, bands 176 and 177 extend generally parallel to one another in a spaced vertical plane. The same is true for bands 178 and 179. At the same time, bands 177 and 178, as well as bands 176 and 179, are preferably arranged in respective common planes. Spring member 185 extends between and interconnects bands 176 and 177, while spring member 186 extends between and interconnects band 178 and 179. Spring members 185 and 186 generally take the form of widened strips which tend to roll-up or curl along their longitudinal axes so as to assume arcuate configurations in a relaxed state. More specifically, curling spring members 185 and 186 are arranged with their respective curved surfaces facing in the same direction such that spring members 185 and 186 will tend to nest with each other when pliable container assumes a closed condition as shown in FIGS. 14 and 15. Bands 176–179 are therefore located at respective top and bottom portions of spring members 185 and 186, with each of the bands 176–179 being convexly curved outwardly, i.e., bands 176 and 177 oppose bands 178 and 179. Like the embodiment of FIG. 1, spring members 185 and 186 have associated spring forces which are greater than the bowing forces of bands 176–179 such that bands 176–179 will tend to flatten when forced together as clearly shown in FIGS. 14 and 15.

Spring members 185 and 186 have associated radiuses of curvature which define how tight the pliable container 152 will be curled when pliable container 152 assumes a closed condition. On the other hand, when pliable container 152 assumes an open condition, bands 176–179 have an associated larger radius of curvature that is generally equal to half the bag in order to hold pliable container 152 open. The axis of rotation about which spring members 185 and 186 operate is at right angles to the axis of rotation about which bands 176–179 operate. This allows a snap action that enables the pliable container 152 to be maintained in both the open condition and the closed condition. Ideally, it should be noted that the curvature for both the bands 176–179 and spring members 185 and 186 is not exactly circular, but rather tapers from a high curvature (small radius) in a center of pliable container 152 towards a nearly zero curvature towards the lateral or transverse ends thereof. Certainly, circular, constant radius curvature bands and spring members function in accordance with the present invention, but tapered elements are considered to better maintain a desired shape for pliable container 152. In addition, it should be realized that a single spring member 185, 186 could be utilized without departing from the invention. However, a better sealing arrangement is accorded closure system 165 when both spring members 185 and 186 are provided.

The selected location for bands 176–179 at the top and bottom of spring members 185 and 186 has been found to provide a good smooth shape to the overall closure system 165 when pliable container 152 is opened. In addition, when the pliable container 152 is closed, if the arc length of spring members 185 and 186 is close to a full 360°, bands 176–179 will abut against each other as clearly shown in FIGS. 14 and 15. This aids bands 176–179 in assuming the flat configuration shown. Of course, the more spring members 185 and 186 coil, the better the seal will be. Additional bands could be added between bands 176, 177, 178 and 179 respectively if extra support is needed to maintain the pliable container 152 in an open condition.

At this point, it should also be realized that the number of bands 176–179 and spring members 185 and 186 could be reduced as well. That is, as little as a single band 176–179 could be provided on one of side walls 155 and 156. However, pliable container 152 is better held in an open condition by providing bands on both opposing side walls 155 and 156 and, most particularly, spaced bands on each side walls 155 and 156. In addition, a single spring member 185, 186 can be provided in connection with one or two bands. However, the additional spring member 185, 186 has been found to greatly improve the created seal when pliable container 152 is closed. In addition, providing the multiple bands 176–179 has been found to greatly enhance the degree to which pliable container 152 opens and remains open.

A considerable distinction between the first embodiments described above and this present embodiment is that the respective bands 176–179 and spring members 185 and 186 are connected through rolling or shiftable hinges. In at least the first two embodiments described above, when the closure systems are open, the associated hinges position the spring members such that their closing force exerts no torque around the fold line. Therefore, the spring members do not fight the bands for dominance. For this reason, the bands need only be gently curved in order to stabilize the spring members in the open position. In contrast, when spring members 185 and 186 are in an open condition, a fairly large torque is still exerted on the bands 176–179 seeking to collapse their bowed, open parallel configuration. Therefore, the bowing in bands 176–179 must be considerably stronger in accordance with this embodiment.

FIGS. 16 and 17 illustrate a slight variant of the invention from that shown in FIGS. 13–15. Due to the similarities between these embodiments, like reference numerals have been used to label corresponding elements, which will not be described again. As with the prior described embodiment, bands 177 and 178 are outwardly bowed in a relaxed state such that pliable container 152A can assume the open condition illustrated in FIG. 16. Upon drawing bands 177 and 178 together, spring members 185 and 186 of closure system 165A will inherently roll-up or curl such that pliable container 152A will take the form illustrated in FIG. 17.

Due to the degree to which closure system 165A rolls up, a very effective sealing arrangement is provided. However, it can also be difficult to grasp the bands 177 and 178 in order to uncoil closure system 165A. To address this concern, a pull tab or strip 190 is provided in accordance with this preferred embodiment. As shown, pull tab 190 is attached adjacent the openable end of pliable container 152A at band 177. In viewing FIG. 17, this arrangement enables tab 190 to be easily grasped and pulled in order to uncoil closure system 165A and assume the open condition of FIG. 16.

Although described with respect to preferred embodiments of the invention, it should be readily understood that various changes and/or modification can be made to the present invention without departing from the spirit thereof. For example, in the embodiment of FIGS. 5–8, the hinge offsets could be eliminated if it is considered acceptable to open bands 76 and 77 beyond the planar configuration shown in FIGS. 5 and 6. Of course, the angle of flanges 90 and 91 could be correspondingly adjusted. Stop arrangements similar to that presented in the embodiment of FIGS. 5–8 could also be incorporated in other embodiments disclosed herein. For instance, bands 126 and 127 in the embodiment of FIGS. 9–12 could include interlaced finger stops which would limit the permissible degree of opening of closure system 125. In the embodiment of FIGS. 9–12, band 127 can be movable through even a greater angle than that shown in the figures. For instance, an angular movement greater than 270° could be provided if it is desired for band 127 not to protrude entirely above pliable container 117 when pliable container 117 is opened. In addition, it should be understood that the number of facets in at least spring members 45 and 95 can greatly vary such that these elements can take various shapes with 2–6 or even more sides. Furthermore, they can be semi-circular, semi-elliptical or the like. In addition, they can have a combination of straight and curved regions without departing from the invention. The shape of the various spring members may also taper in width or thickness, particularly at their hinges in order to distribute strain more evenly or to simply reduce the amount of necessary spring material. It should also be realized that the various legs discussed above in connection with attaching the spring members to the bands, such as legs 54 and 55 in the embodiment of FIGS. 1–4, legs 104 and 105 in the embodiment of FIGS. 5–8, legs 141 and 142 in the embodiment of FIGS. 9–12, are not necessary elements in the closure systems of the present invention. In essence, these legs tend to act as handles in opening and/or closing of the various pliable containers. It is only important that the spring member interconnect the bands and these connections could be done in various ways without departing from the spirit of the invention. Although the preferred embodiments described in this application utilize plastic as the material for the various bands, other materials including metal could also be used. In addition, the bands could vary in dimension and could be as small as a wire, with the bands having constant or varying widths and cross-sectional configurations, regardless of whether the bands are formed integral with the pliable container or separately therefrom. Furthermore, provisions can be incorporated to enhance the sealing of the container, which can be entirely or partially pliable. If desired, additional fasteners, e.g. snaps, hook and loop or zip-type connectors, can be added if it is desired to more securely maintain the container in a closed condition. Finally, the particular manner in which the closure systems are formed and provided on the pliable containers can greatly vary in accordance with the present invention. For instance, the closure system of at least the first three disclosed embodiments could be extruded as a unit, with post treating steps being taken to develop the biasing force for the spring members. The closure system can then be applied to a pliable container during the overall manufacturing of the container, including in the ways disclosed in my co-pending U.S. patent application Ser. No. 08/885,667 filed Jun. 30, 1997, now U.S. Pat. No. 6,022,114 entitled "Closure System for a Pliable Container and Method and Apparatus for Producing the Same", the disclosure of which is herein incorporated by reference. In any event, the invention is only intended to be limited by the scope of the following claims.

I claim:

1. In a pliable container including at least first and second opposing side walls and an openable end defined, at least in part, by upper terminal edges of the side walls, a closure system for repetitively opening and sealingly closing the openable end of the pliable container comprising:

a first band extending transversely across and being attached to the first side wall adjacent the openable end at a first level;

a second band extending transversely across and being attached to the first side wall at a position spaced from the first band, said second band being arranged above the first level when the closure system assumes an open condition, wherein an interior of the pliable container can be accessed through the openable end, and nests with the first band substantially in the first level when the closure system assumes a closed condition, wherein the openable end of the pliable container is sealingly closed; and a spring member coupled to each of the first and second bands, with said spring member creating a biasing force acting between the first and second bands to at least retain the first and second bands nested when the closure system is in the closed condition.

2. The closure system according to claim 1, wherein, in the closed condition, at least a portion of the second side wall of the pliable container is located between the first and second bands.

3. The closure system according to claim 2, wherein, in the closed condition, two layers of at least one of the opposing side walls of the pliable container is located between the first and second bands.

4. The closure system according to claim 1, wherein the first and second bands are hingedly interconnected.

5. The closure system according to claim 4, wherein the first and second bands are hingedly interconnected through a portion of the pliable container.

6. The closure system according to claim 1, wherein the spring member is hinged to each of the first and second bands.

7. The closure system according to claim 6, wherein the spring member is directly hinged to each of the first and second bands.

8. The closure system according to claim 7, wherein the spring member is hinged to the first and second bands at positions which are offset from respective surfaces of the first and second bands.

9. The closure system according to claim 1, wherein the spring member applies a biasing force to the first and second bands in each of the open and closed conditions.

10. The closure system according to claim 1, wherein each of the first and second bands is directly attached to the pliable container.

11. The closure system according to claim 1, wherein both the first and second bands are directly attached to the pliable container.

12. The closure system according to claim 1, wherein at least one of the first and second bands is bowed in a relaxed state.

13. The closure system according to claim 1, wherein the spring member comprises at least one clip fixedly secured to the first and second bands.

14. The closure system according to claim 1, further comprising at least one stop member for limiting a degree of travel of the spring member from the closed condition to the open condition.

15. The closure system according to claim 14, wherein the at least one stop member comprises first and second upstanding flanges connected to the first and second bands respectively, said first and second upstanding flanges being adapted to abut to limit the degree of travel of the spring member.

16. The closure system according to claim 1, wherein the spring member curls when the closure system shifts from the open condition to the closed condition.

17. The closure system according to claim 1, further comprising: at least one additional, bowed band attached to the second side wall of the pliable container.

18. In a pliable container including at least first and second opposing side walls and an openable end defined, at least in part, by upper terminal edges of the side walls, a closure system shiftable between an open condition, wherein an interior of the pliable container can be accessed through the openable end, and a closed condition, wherein the openable end of the pliable container is sealingly closed, comprising:

a first band extending transversely across the first side wall adjacent the openable end at a first level;

a second band extending transversely across the first side wall, said second band being arranged above the first level when the pliable container is in the open condition and nests with the first band substantially in the first level when the pliable container is placed in the closed condition;

spring means for biasing the first and second bands towards each other when the closure system assumes the closed condition; and means for limiting a degree of travel of the spring means from the closed condition to the open condition and enabling the closure system to be selectively maintained in the open condition.

19. The closure system according to claim 18, wherein, in the closed condition, at least a portion of the second side wall of the pliable container is located between the first and second bands.

20. The closure system according to claim 19, wherein, in the closed condition, two layers of at least one of the opposing side walls of the pliable container is located between the first and second bands.

21. The closure system according to claim 18, wherein the first and second bands are hingedly interconnected.

22. The closure system according to claim 21, wherein the first and second bands are hingedly interconnected through a portion of the pliable container.

23. The closure system according to claim 18, wherein the spring means is hinged to each of the first and second bands.

24. The closure system according to claim 23, wherein the spring means is directly hinged to each of the first and second bands.

25. The closure system according to claim 24, wherein the spring means is hinged to the first and second bands at positions which are offset from respective surfaces of the first and second bands.

26. The closure system according to claim 18, wherein the spring means applies a biasing force to the first and second bands in each of the open and closed conditions.

27. The closure system according to claim 18, wherein each of the first and second bands is directly attached to the pliable container.

28. The closure system according to claim 18, wherein the first band is directly attached to the pliable container and the second band is connected to the pliable container through the first band.

29. The closure system according to claim 18, wherein at least one of the first and second bands is bowed in a relaxed state.

30. The closure system according to claim 18, wherein the spring means comprises at least one clip fixedly secured to the first and second bands.

31. The closure system according to claim 30, wherein the limiting means includes at least one stop member carried by the first band for limiting a degree of travel of the spring means from the closed condition to the open condition.

32. The closure system according to claim 31, wherein the at least one stop member comprises first and second upstanding flanges connected to the first and second bands respectively, said first and second upstanding flanges being adapted to abut to limit the degree of travel of the spring means.

33. The closure system according to claim 18, wherein the spring means curls when the closure system shifts from the open condition to the closed condition.

34. The closure system according to claim 18, further comprising: at least one additional, bowed band attached to the second side wall of the pliable container.

35. The closure system according to claim 18, wherein the pliable container has an associated transverse width defined by the opposing side walls, each of the first and second bands having an associated length which is substantially equal to the transverse width of the pliable container and an associated width that extends in a longitudinal direction of the pliable container.

36. The closure system according to claim 18, wherein each of the first and second bands is constituted by an elongated, plastic strip.

37. The closure system according to claim 18, wherein the pliable container comprises a gusseted bag, with the opposing side walls constituting main sides of the gusseted bag.

* * * * *